United States Patent [19]

Murai et al.

[11] Patent Number: 4,775,429

[45] Date of Patent: Oct. 4, 1988

[54] LARGE DIAMETER HIGH STRENGTH ROLLED STEEL BAR AND A PROCESS FOR THE PRODUCTION OF THE SAME

[75] Inventors: Teruyuki Murai; Yoshihiro Hashimoto, both of Itami, Japan

[73] Assignee: Sumitomo Electric Industries, Ltd., Osaka, Japan

[21] Appl. No.: 18,730

[22] Filed: Feb. 24, 1987

Related U.S. Application Data

[63] Continuation of Ser. No. 754,610, Jul. 12, 1985, abandoned.

[30] Foreign Application Priority Data

| | | | |
|---|---|---|---|
| Jul. 16, 1984 | [JP] | Japan | 59-145914 |
| Aug. 7, 1984 | [JP] | Japan | 59-165225 |
| Aug. 7, 1984 | [JP] | Japan | 59-165226 |
| Aug. 22, 1984 | [JP] | Japan | 59-174369 |
| May 28, 1985 | [JP] | Japan | 60-114550 |

[51] Int. Cl.[4] ..... C21D 8/06

[52] U.S. Cl. ..... 148/12 B; 148/12 F; 148/12.3; 148/320; 148/328; 148/333

[58] Field of Search ..... 148/12 B, 12 F, 12.3, 148/320, 328, 333; 420/104, 115

[56] References Cited

U.S. PATENT DOCUMENTS

| | | | |
|---|---|---|---|
| 4,046,600 | 9/1977 | Yamakoshi et al. | 148/12 B |
| 4,123,296 | 10/1978 | Yamakoshi et al. | 148/12 B |
| 4,426,236 | 1/1984 | Sugino et al. | 148/36 |

*Primary Examiner*—Deborah Yee

*Attorney, Agent, or Firm*—Wenderoth, Lind & Ponack

[57] ABSTRACT

A large diameter high strength hot rolled steel bar consisting of a low alloy steel having a carbon content of 0.3 to 0.9% and a metallurgical structure with a interlammelar spacing of 0.05 to 0.15 μm, and having a diameter of at least 20 mm, a tensile strength of at least 120 kg/mm$^2$ and a reduction of area of at least 20% is produced by a process comprising cooling a hot rolled steel bar at a constant rate, characterized by carrying out the cooling in such a controlled manner that the perlite transformation is started at a temperature of ranging from Tc to (Tc+40° C.) wherein Tc is the critical temperature at which a cooling curve at a constant rate is tangent to the perlite transformation starting line of the continuous cooling transformation curve and the maximum temperature during the transformation is suppressed to at most (Tc+80° C.).

18 Claims, 18 Drawing Sheets

(a)

x5000

(b)

x5000

(c)

x5000

(d)

x5000

LARGE DIAMETER HIGH STRENGTH ROLLED STEEL BAR AND A PROCESS FOR THE PRODUCTION OF THE SAME

This application is a continuation, of now abandoned application Ser. No. 754,610, filed July 12, 1985.

BACKGROUND OF THE INVENTION

1. Field of the Invention

This invention relates to a large diameter hot rolled steel bar having a novel metallurgical structure in cross section, excellent in strength as well as toughness and a process for the production of the same by controllig the perlite transformation temperature.

2. Description of the Prior Art

Up to the present time, hot rolled steel rods have generally been cooled by the so-called Pb patenting using a lead bath for cooling, air patenting or warm water patenting, but these methods have some problems. In the Pb patenting method, for example, rolled steel rods with a higher strength can be obtained, but the use of a lead bath results in worsening of the working environment, i.e. environmental pollution. Moreover, the air patenting or warm water patenting method has the drawback that cooling cannot be effected more stably and rapidly as compared with the Pb patenting and method and accordingly, the phase transformation cannot be accelerated at a low temperature.

On the other hand, high strength steel rods can also be obtained by quenching and tempering, but the so-called tempered martensite steel has a tendency to be inferior to perlite steel in the delayed fracture property. Thus, it is necessary from the standpoint of reliability to obtain a higher strength in perlite steel. However, in the case of a large diameter steel bar, in particular, having a diameter exceeding 20 mm which holds a very large quantity of heat, the cooling rate is slow and the perlite transformation cannot be effected at a low temperature by the air patenting or warm water patenting method of the prior art. That is, the transformation temperature becomes higher than in the case of small diameter rods and it is difficult to obtain a tensile strength of at least 120 kg/mm$^2$ without addition of large amounts of elements of increasing hardenability.

High carbon steel bars requiring a high strength, such as steel bars for PC (prestressed concrete), have hitherto been produced by heating a billet, hot rolling and then cooling at a certain cooling rate in a cooling bed, for example, by natural air cooling, forced air coolig or mist cooling, thereby causing perlite transformation in the steel of austenite structure.

When the hot rolled steel rod of austenite structure is cooled immediately after rolling to cause perlite transformation, however, there arises a problem in that the toughness is low immediately after the production. As indexes for indicating the toughness, there are values as to elongation and reduction of area and the lowering of toughness corresponds to that of the reduction of area, in particular. Since the toughness, i.e. reduction of area is recovered by ageing after the passage of a long time such as several hundred hours or longer, although not completely, even when the steel rod is naturally allowed to stand, this is not a large disadvantage when producers have generally a lot of the stock and there is a long period of time until the steel bar is used, as in the past. Of late, however, the variety of steels, outer shapes, etc. have been so diversified that producers cannot have a lot of the stock corresponding thereto and cannot avoid putting the stock on the market, depending upon the use, before a complete ageing recovery is attained. In this case, the toughness is not uniform in the steel bar and there is often danger, in particular, when using under a large tension.

Thus, in order to improve the toughness, it is taken into consideration to carry out a forced ageing treatment, but the thus resulting steel bar has also a disadvantage that the yield stress is low in proportion to the breaking stress. Generally, a PC material is loaded with a stress of 70 to 80% to the yield stress of a steel bar, so a higher yield stress is desired for the steel bar. In addition, the above described steel bar has further disadvantages of being inferior in straightness and ease of handling.

Hot rolled steel bars of medium or high carbon steel are ordinarily produced by heating a billet and then rolling at once to a final shape in several to several ten stages, and after rolling, cooling the steel rod in a cooling bed, whereby to transform the austenite structure to perlite structure and to give a relatively high tension steel.

The properties of medium or high carbon steels are varied by the conditions of a heat treatment applied and in the prior art method comprising rolling a billet at once and cooling, the temperature distribution of the billet in a heating furnace affects the temperature distribution of the rolled material during and after the final rolling, thus resulting in dispersion of the mechanical properties of the product in the longitudinal direction. When the rolling operation runs into trouble on the way even if the temperature distribution in a heating furnace is uniform, delay of the rolling line takes place and the temperature of the rolled material is thus lowered, resulting in dispersion of the mechanical properties of the product similarly.

SUMMARY OF THE INVENTION

It is an object of the present invention to provide a large diameter steel bar of a high strength as well as high toughness, having a diameter of more than 20 mm, whereby the above described disadvantages of the prior art can be overcome.

It is another object of the present invention to provide a large diameter hot rolled steel bar having a novel metallurgical structure obtained by controlling the perlite transformation temperature.

It is a further object of the present invention to provide a process for the production of a large diameter steel bar of a high strength and high toughness, having a diameter of at least 20 mm.

It is a still further object of the present invention to provide a process for the production of a medium or high carbon steel bar with uniform mechanical properties over the whole length.

It is a still further object of the present invention to provide a process for the production of a hot rolled high carbon steel bar stably excellent in toughness.

It is a still further object of the present invention to provide a hot rolled high carbon steel bar stably excellent in straightness and having a high yield stress.

These objects can be attained by a large diameter high strength hot rolled steel bar consisting of a low alloy steel having a carbon content of 0.5 to 0.9% and a metallurgical structure with a interlamellar spacing of 0.05 to 0.15 $\mu$m, and having a diameter of at least 20 mm, a tensile strength of at least 120 kg/mm$^2$ and a reduction of area of at least 20%, and a process for the production of a large diameter high strength hot rolled steel bar comprising cooling a hot rolled steel bar at a constant rate, characterized by carrying out the cooling in such a controlled manner that the perlite transformation is started at a temperature ranging from Tc to Tc+40° C. wherein Tc is the critical temperature at which a constant rate cooling curve is in contact with the perlite transformation starting line of CCT curve of the steel bar and the maximum temperature during the transformation is suppressed to at most (Tc+80° C.).

BRIEF DESCRIPTION OF THE DRAWING

The accompanying drawings are to illustrate the principle and merits of the present invention in greater detail.

DETAILED DESCRIPTION OF THE INVENTION

The inventors have made various efforts to solve the above described problems and consequently, have succeeded in obtaining a large diameter high strength hot rolled steel bar with a novel metallurgical structure by controlling the perlite transformation temperature while holding additive alloy elements as little as possible.

Accordingly, such a large diameter high strength hot rolled steel bar can be obtained by a process comprising cooling a hot rolled steel bar at a constant rate, characterized in that said cooling is carried out in such a controlled manner that the perlite transformation is started at a temperature of ranging from Tc to (Tc 30 40° C.) wherein Tc is the critical temperature at which a cooling curve at a constant rate is tangent to the perlite transformation starting line (Ps) of the continuous cooling transformation (CCT) curve and the maximum temperature during the transformation is suppressed to Tc+80° C. or less.

Figure 1:
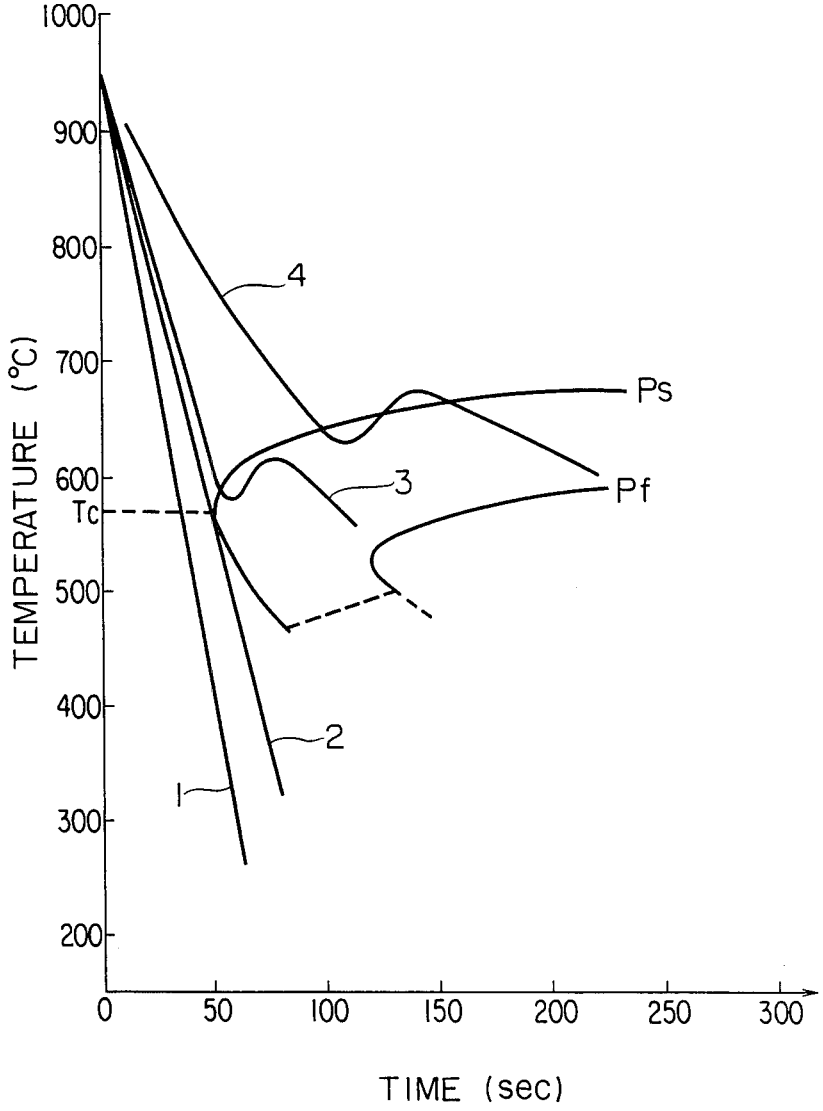
FIG. 1 is a graph illustrating one example of a process for producing a rolled steel bar according to the present invention and showing CCT curves of the steel bar, i.e. perlite transformation starting line Ps, perlite transformation finishing line Pf and cooling curve 3 according to the present invention, Tc being critical temperature at which a constant rate cooling curve is tangent to Ps.

FIG. 1 shows one example of the perlite transformation starting line (Ps) and perlite transformation finishing line (Pf) of CCT curves of a steel bar with a diameter of 32 mm, containing 0.75% C-0.81% Si-1.21% Mn-0.80% Cr. % used in this specification is to be taken as % by weight unless otherside indicated.

As a result of our studies, it is found that when a steel rod or bar heated in the austenite temperature zone is cooled at a constant rate, the constant rate cooling represented by Curve 1 in FIG. 1 does not result in Tc and that represented by Curve 2 results in Tc. It is further found that a novel metallurgical structure and tensile strength of at least 120 kg/mm$^2$ can be obtained by effecting controlled cooling in such a manner that the perlite transformation of the steel bar is started at a temperature of ranging from Tc to (Tc+40° C.) and the maximum temperature of transformation latent heat due to the perlite transformation is held at Tc+80° C. or less. In FIG. 1, the cooling curve according to the present invention is as shown by Curve 3 and that according to the air cooling method of the prior art is as shown by Curve 4.

Limitation of the perlite transformation starting temperature to Tc to Tc+40° C. is because if lower than Tc, the perlite transformation does not take place, but the martensite transformation does take place, while if higher than (Tc+40° C.), a desired strength cannot be obtained. Limitation of the maximum temperature transformation latent heat due to the perlite transformation to Tc+80° C. or less is because if higher than Tc+80° C., a desired strength cannot be obtained by the generation of heat even though the perlite transformation temperature is within the range of Tc to (Tc+40° C.).

Generally, the smaller is the crystal grain size, i.e. the lower is the finishing rolling temperature, the more excellent is the toughness, while the smaller is the crystal grain size, the worse is the hardenability. Thus, the perlite transformation takes place at a high temperature, resulting in difficulty of obtaining both a higher strength and higher toughness.

According to the present invention, however, even a rolled steel bar having a crystal grain size of smaller than ASTM No. 8 can be obtained with a diameter of 20 mm or more, tensile strength of 120 kg/mm$^2$ or more and reduction of area of 20% or more by effecting forced cooling to control the perlite transformation temperature.

Figure 3:
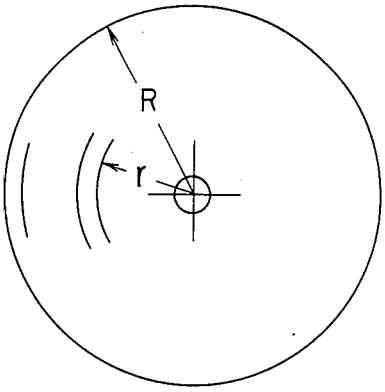
FIG. 3 is a cross-sectional view of a steel bar to show the position of measuring the interlamellar spacings of perlite.
Figure 4:
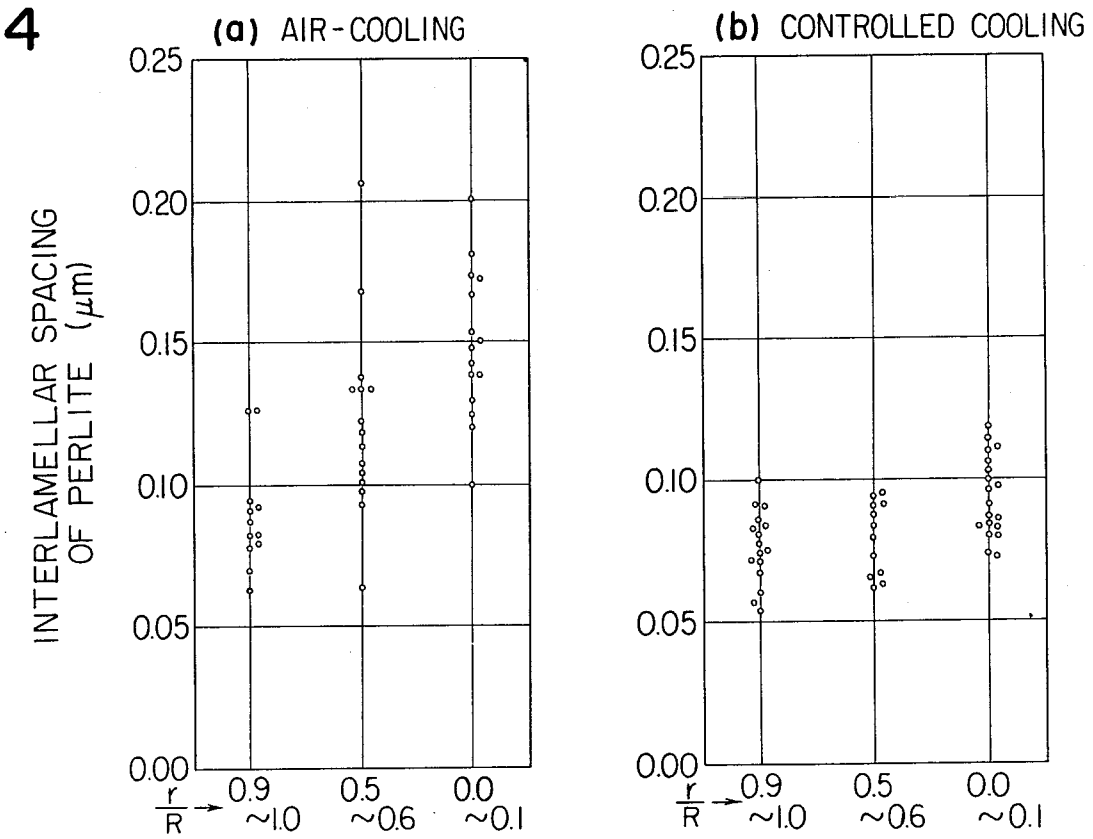
FIG. 4 (*a*) and (*b*) are graphs showing the interlamellar spacing of perlite in the case of air cooling and controlled cooling respectively.

The hot rolled steel bar of the present invention has a novel metallurgical structure in cross section with an interlamellar spacing of perlite of 0.05 to 0.15 μm. For example, a steel having a chemical composition of 0.71% C, 0.79% Si, 1.25% Mn, 0.78% Cr, 0.009% P and 0.013% S is rolled in a diameter of 32 mm at a finishing rolling temperature of 980° C. and then allowed to stand in the air to cause the perlite transformation, or then subjected to the controlled cooling using a mist, i.e. jet flow of air and water. In each case, the cross section of the resulting steel bar is observed by an electron microscope to measure the inter-lamellar spacing of perlite at three positions of a surface portion (r/R=0.9–1.0), intermediate portion (r/R=0.5–0.6) and central portion (r/R=0.0–0.10) as shown in FIG. 3 (R=16 mm). The results are shown in FIG. 4. That is, FIG. 4(*a*) shows the inter-lamellar spacing of perlite of the air cooled steel bar and (b) shows that of the control cooled steel bar according to the present invention. In the case of the air cooled steel bar, the inter-lamellar spacing of perlite increases from the surface to the center, some spacings exceeding 0.2 μm at the central portion. This phenomenon is remarkable in large diameter steel bars. That is to say, the perlite transformation starts near the surface in cross section and gradually proceeds toward the center so that the temperature of the central portion be higher by heat generated during the transformation. Consequently, the transformation takes place at a higher temperature nearer the center to enlarge the inter-lamellar spacing of perlite. When the controlled cooling is carried out using a mist on the way of transformation according to the present invention, on the other hand, there is also a tendency that the inter-lamellar spacing increases toward the center as shown in FIG. 4(*b*), but this is very little and the spacing is at most 0.13 μm, much smaller than in the case of the air cooled steel bar.

Figure 5:
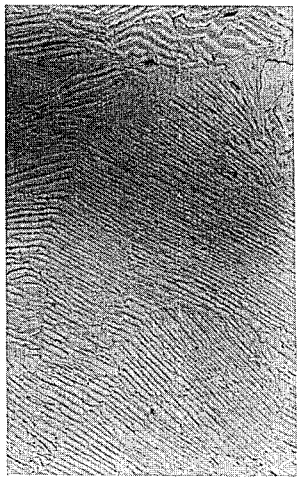
FIG. 5 (*a*), (*b*), (*c*) and (*d*) are photomicrographs of the perlite structures in the case of air cooling of the prior art and controlled cooling of the present invention.
Figure 5:
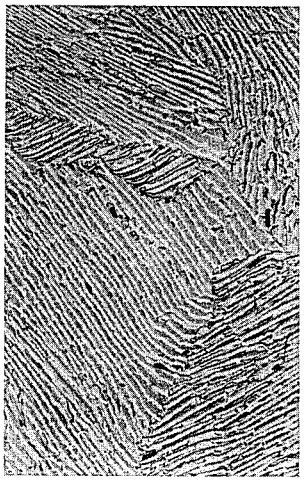
Figure 5:
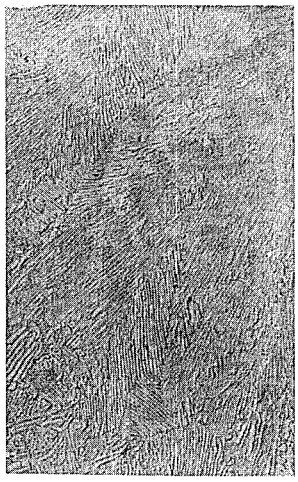
Figure 5:
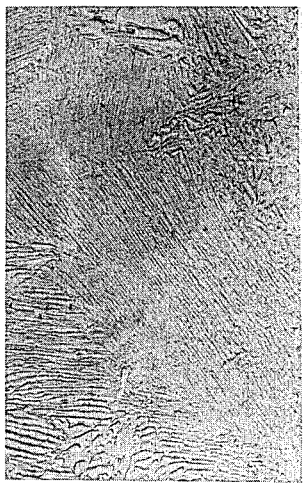

FIG. 5(*a*) to (*d*) are typical transmission electron micrographs (x5000) of the air cooled and control cooled materials, (*a*) and (*b* ) showing respectively the surface portion and central portion in the case of air-cooling by the prior art and (c) and (d) showing respectively those in the case of controlled cooling by the present invention, from which it is apparent that the interlamellar spacing of the latter case is smaller. In general, the tensile strength and reduction of area increase with the decrease of the inter-lamellar spacing and in this respect, the steel bar of the present invention, whoses inter-lamellar spacing of perlite is at most 0.13 m both at the central portion and circumferetial portion, has an ideal metallurgical structure. Since the steel bar of this kind is used as a PC steel bar, in particular, it is important to have a uniform strength over the whole length and if there is a local weak portion, breaking occurs from this portion. The steel bar of the present invention has a uniform structure over the whole length and toward the central portion, thus exhibiting a higher strength over the whole length uniformly.

Control of the temperature according to the present invention, as set forth above, is carried out, for example, by arranging nozzles in such a manner that water or a mist of air and water is circumferetially sprayed uniformly to a rolled steel bar, spraying continuously or intermittently water or a mist while controlling the quantity of the water and/or air, thereby imparting a suitable cooling rate thereto and controlling the perlite transformation starting temperature. In addition, after the start of transformation, the maximum temperature of transformation latent heat is controlled by spraying water or a mist.

When the above described controlled cooling is carried out for a rolled steel bar whose crystal grain size is adjusted to ASTM No. 8 or smaller than the same by controlling the finishing rolling temperature, there is obtained a steel bar with an increased reduction of area in addition to an increased tensile strength.

In a preferred embodiment of the present invention, a hot rolled steel bar is subjected to a rotating motion, forwarding motion and/or forwarding and backing motion using one or two rolls to make cooling uniform, while control cooling the steel bar at a temperature of 950° to 500° C by blast and/or mist. Blast is applied to a hot rolled steel bar uniformly and circumferentially over the whole length thereof to control the temperature of the steel bar at 950° to 500° C.. When a steel bar has a large quantity of heat and it is hard to control the temperature thereof to the above described range by blast, it is preferable to spray a mist circumferentially and uniformly. Since the use of a mist throughout the process is not economical, however, blast cooling can be carried out before the start of the perlite transformation and mist spraying can be employed only in the case of suppressing heat recuperation. A uniformly controlled cooling can effectively be achieved by cooling a hot rolled steel bar at a temperature range of 950° to 500° C. as described above, while imparting thereto a rotating motion or forwarding motion.

In order to impart a rotating motion to a steel bar while imparting a forwarding and backing motion thereto, it is preferable to arrange rolls for rotation and rolls for forwarding and backing and to reverse the rolls for forwarding and backing at intervals of a certain time, or it is preferable to arrange drum-shaped (centrally narrowed) rolls in parallel and slantly to the axial direction of the steel bar and to reverse the rotation thereof at intervals of a certain time.

Furthermore, in the present invention, it is preferable to employ a controlled cooling system for ascertaining the specified thermal hysteresis as described above, comprising a computing unit, means for measuring the surface temperature of a steel bar and cooling means composed of a plurality of cooling units divided. "Time-Temperature", as a standard for controlled cooling, is computed from the diameter of a steel bar, chemical components thereof and finishing rolling temperature. The surface temperature of the steel bar is measured at suitable intervals from the start of cooling to the completion of the perlite transformation after hot rolling and input into the computing unit. Comparing the difference with "TimeTemperature" of standard, the cooling system is operated correspondingly to the difference.

The cooling means is composed of a plurality of divided cooling units each capable of controlling independently the cooling powder. Temperature sensors are respectively arranged before the divided cooling zones and the surface temperature of the steel bar is continuously measured. In the computing unit, the chemical composition and size of the rolled steel bar and the finishing rolling temperature are input to provide previously a cooling pattern as standard (as shown by 8 in FIG. 7), the temperature of the steel bar on each of the cooling units is compared with that of the standard cooling pattern and from this temperature difference, the cooling power is controlled. According to this controlled cooling system, a steel bar undergoes the above described thermal hysteresis thus obtaining a stable quality and high strength.

Figure 7:
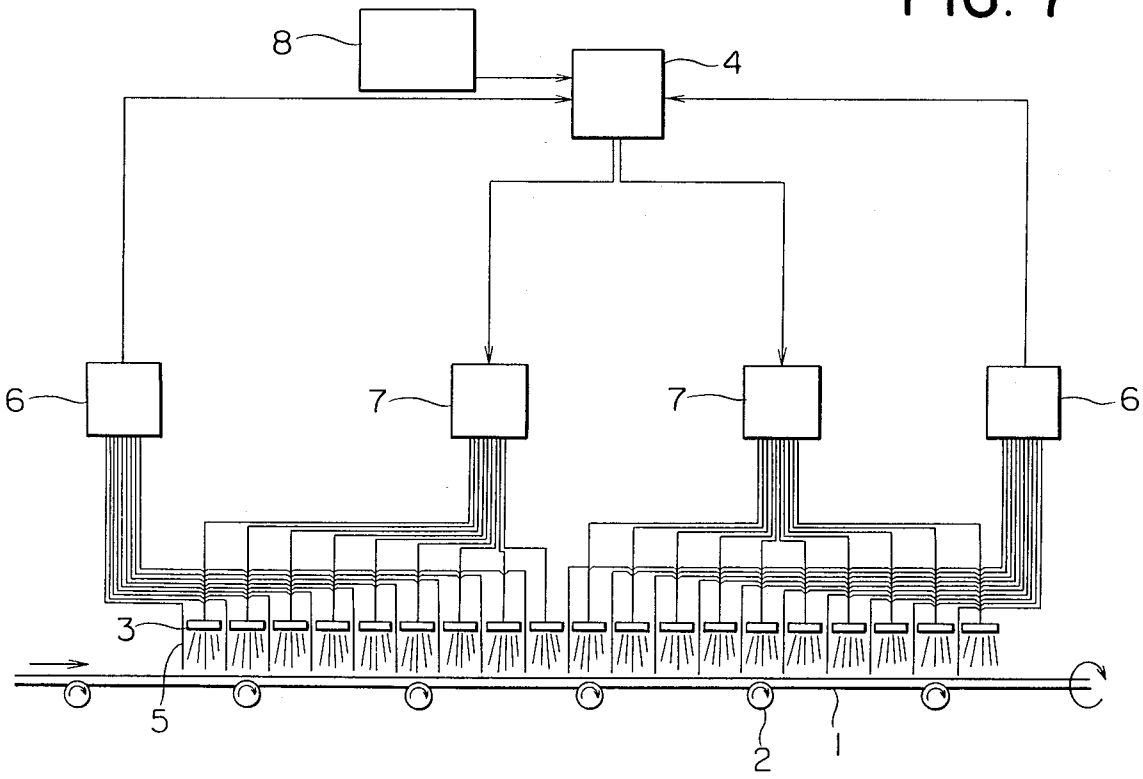
FIG. 7 is a schematic view of one embodiment of an apparatus for carrying out the controlled cooling according to the present invention.

Referring to FIG. 7, steel bar 1 is subjected to rotation and forwarding motion by means of drum-shaped rolls 2 arranged slantly to the travelling direction of steel bar 1 and cooled by a plurality of divided cooling units 3 operated independently by the demand of computing unit 4. Temperature sensers 5 of the surface temperature of steel bar 1 are provided just before the cooling units to measure 6 continuously the temperature and the average temperatures at intervals of a certain time are input into computing unit 4 for the purpose of cooling control 7. As the cooling medium, there can be used any of blast, aqueous spray and mixed jet flows of air and water. In FIG. 7, a steel bar is moved in the axial direction, but of course, it can be moved in parallel. As illustrated above, a steel bar of uniform quality can be produced by controlling cooling of the steel bar and carrying out the perlite transformation.

Figure 11:
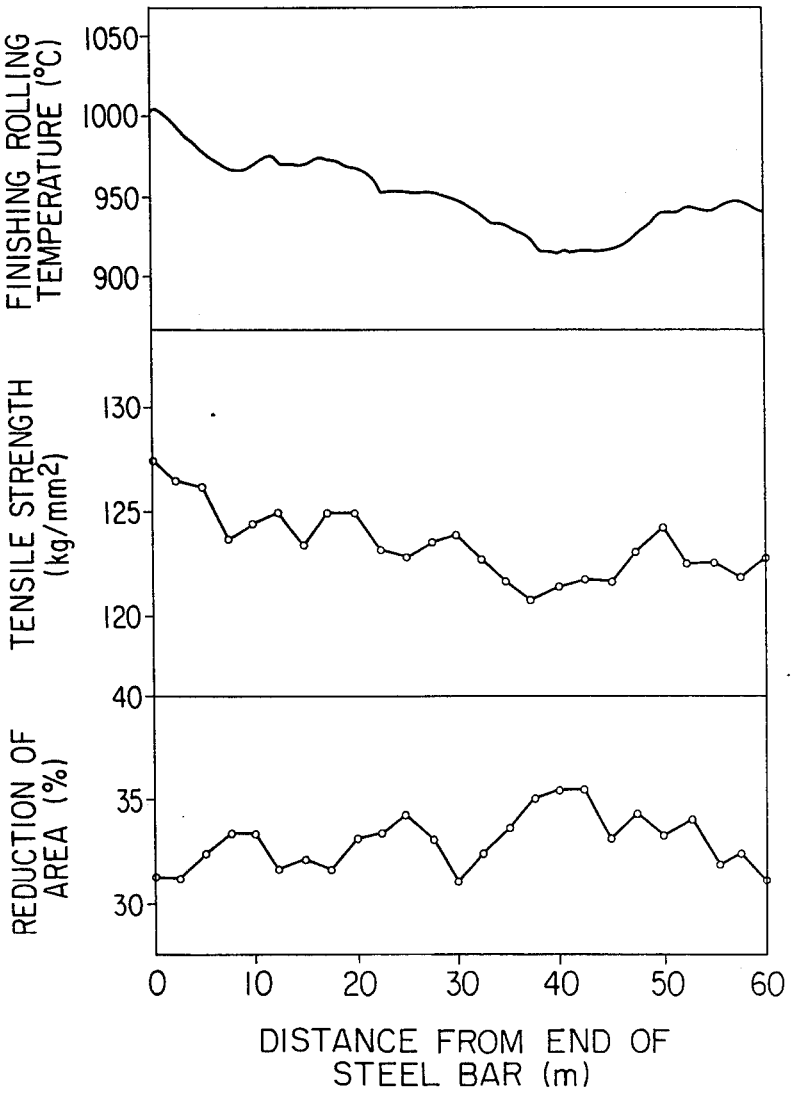
FIG. 11 is a graph showing the relationship of the finishing rolling temperature, tensile strength and reduction of area vs the position from the end of a steel bar in the case of the rolled steel bar of the prior art.

Referring to FIG. 11, there are shown the temperature distribution of a rolled steel bar immediately after the final rolling and the mechanical property distribution thereof after cooling, the rolled steel bar being obtained by subjecting, for example, a high carbon steel billet of 160×250 mm in cross section and containing 0.75% C-0.81% Si-1.21% Mn-0.80% Cr to rolling of 12 passes in a steel bar of 60 m in length and 32 m in diameter, followed by cooling in a cooling bed. That is to say, a temperature width of about 90° C. is found in the steel bar immediately after rolling and as to the mechanical properties of steel bar after cooling, the tensile strength is higher and reversely, the toughness (reduction of area) is lower at higher temperature portions, while the tensile strength is lower and the toughness (reduction of area) is higher at lower temperature portions. For this temperature distribution, there are deviations of about 7 $kg/mm^2$ in tensile strength and about 5% in reduction of area. This is due to that when the rolling temperature is lower, the austenite grain size of the steel bar is smaller and the toughness is correspondingly more improved, but the hardenability is lowered, thus resulting in the perlite transformation at a high temperature and lowering of the strength.

Figure 12:
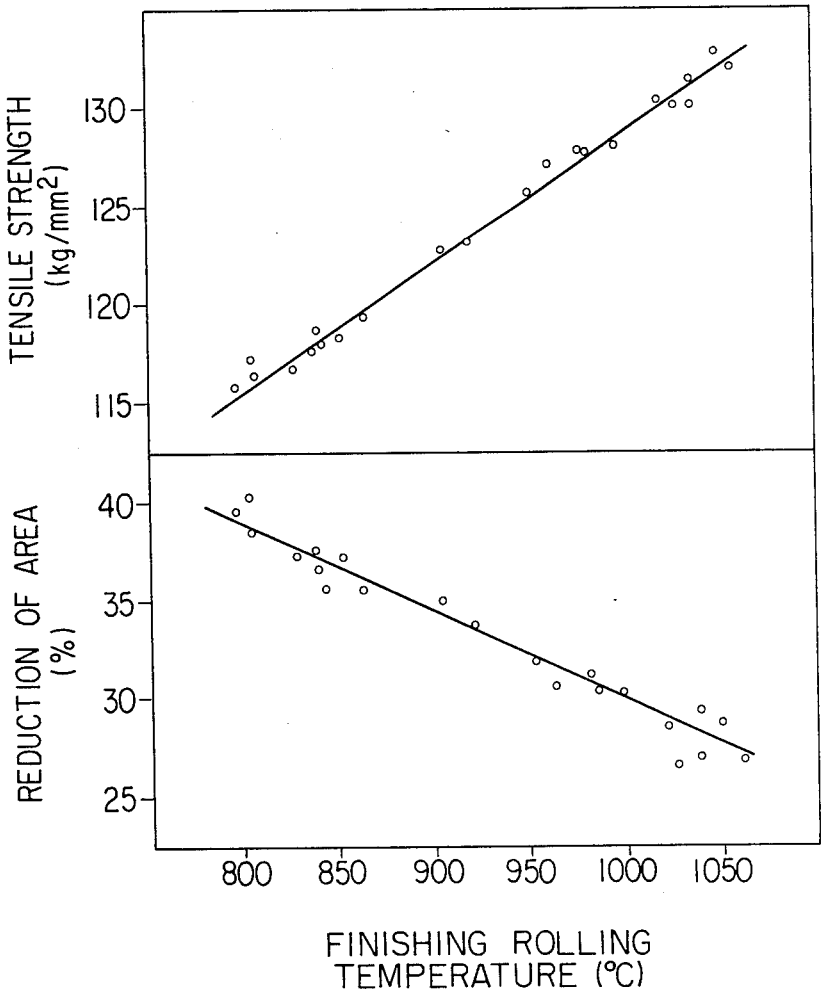
FIG. 12 is a graph showing the relationship of the tensile strength and reduction of area vs the finishing rolling temperature.

According to the results of our studies, there are fluctuations of about 8 $kg/mm^2$ in strength and about 5 % in reduction of area for a fluctuation of 100° C. in finishing rolling temperature in the case of the steel bar of the above described kind, as shown in FIG. 12.

This embodiment is made as a result of our studies and consists in a process for producing a hot rolled steel bar of medium or high carbon steel having uniform mechanical properties over the whole length, characterized by holding a material to be rolled in a holding furnace during rolling and then subjecting to rolling with a total reduction of area of at least 10 % .

Steels suitable for this embodiment contain 0.3 to 0.9% C, 0.25 to 2.0% Si, 0.5 to 2.0% Mn, 0.3 to 1.0 % Cr and the balance Fe and unavoidable impurities. These steels are heated at a temperature at which the austenite structure is stable, rolled and cooled to cause the perlite transformation, whereby to obtain steel bars each having a high strength as well as high toughness. The cooling is carried out by the controlled cooling as described above.

As the holding furnace, there can be used any of known heating furnace using gases, electricity and oils, but the holding conditions should be a temperature range of 800° to 1000° C. with a temperature fluctuation of at most 60° C. width over the whole length of a material to be rolled, since if the temperature is lower than 800° C., ferrite phase possibly appears, while if higher than 1000° C., the austenite grain size before perlite transformation gets larger to lower the toughness. If there is a fluctuation of 60° C. or higher in temperature width, the tensile strength is changed by at least 5 $kg/mm^2$ over the whole length of a steel bar of this kind and uniform mechanical properties cannot be obtained.

Only by holding a steel bar in a holding furnace, the effect of thermal hysteresis cannot completely be removed and accordingly, uniform mechanical properties cannot be obtained only by holding in a holding furnace, withdrawing and cooling as it is. In the embodiment of the present invention, therefore, a steel material to be rolled is held in a holding furnace and then subjected to rolling with a total reduction of area of at least 10% . The austenite crystal grains, made uniform in the holding furnace, are once broken by rolling at the final temperature and then recovered for recrystallization. Consequently, the crystal structure of the rolled steel bar is made uniform to give uniform mechanical properties among product steel bars and in the steel bar.

Since a sufficient recrystallization cannot be given by rolling with a reduction of area of less than 10% and the austenite crystal grains retain as stretched by rolling, control of the austenite crystal grain size cannot be accomplished by holding-rolling-recrystallizing, resulting in deviations of the tensile strength and reduction of area. On the other hand, when a steel material is subjected to rolling with a reduction of area of at least 10% , recrystallization completely takes place to give a predetermined austenite crystal grain size over the whole length and even after cooling, the structure is made uniform, thus attaining the objects of the present invention, i.e. making uniform the mechanical properties among steel bars and in the steel bar.

According to the embodiment of the invention, as illustrated above in detail, a hot rolled steel bar of medium or high carbon steel having uniform mechanical properties over the whole length thereof can be obtained only by holding a material to be rolled in a holding furnace on the way of rolling more readily than the prior art methods.

In a further embodiment of the present invention, a hot rolled steel bar of medium or high carbon steel having uniform mechanical properties over the whole length thereof and excellent in stregth and toughness is produced by continuously measuring the surface temperature of the steel bar at the start of hot rolling or on the way of hot rolling prior to the specified controlled cooling as described above, feeding forward the results to effect a forces cooling, controlling the fluctuation width of temperature distribution to at most 60° C. over the whole length thereof for a predetermined temperature in the temperature range of 800° to 1000° C. and thereafter subjecting to rolling with a total reduction of area of at least 10% .

Steels suitable for this embodiment contain 0.5 to 0.9% C, 0.25 to 2.0% Si, 0.5 to 2.0% Mn, 0.3 to 1.0 % Cr and the balance Fe and unavoidable impurities. These steels are heated at a temperature at which the austenite structure is stable, rolled and cooled to cause the perlite transformation, whereby to obtain steel bars each having a high strength as well as high toughness. The forced cooling is carried out by the use of blast or mist.

In the present invention, it is preferable to obtain a high toughness high carbon steel bar by subjecting a high carbon steel bar to the perlite transformation after hot rolling, cooling to room temperature and heating and holding at a temperature of 100° to 500° C. for 3 to 50 hours, or when the steel bar is cooled to 100° to 500° C. during the step of cooling after rolling and holding at this temperature, thereby subjecting the steel bar to a forced ageing.

The inventors have found that the toughness of a steel bar can further be raised by subjecting a hot rolled steel bar to the perlite transformation under the controlled cooling condition and then to the forced ageing under the above described condition. Generally, it has hitherto been considered that the ageing recovery cannot be given unless a steel material is once cooled to room temperature and then heated again, but the inventors, as a result of our studies, have found that a similar ageing recovery can be obtained even by holding at the above described temperature on the way to cooling immediately after hot rolling.

Since the ageing is carried out at a relatively low temperature in these methods, energy-saving is possible by utilizing the waste heat from the rolling and heating furnace for a furnace for heating after rolling or furnace for temperature holding, and the production process including the rolling step can be simplified or completed as a through process. In the case of the latter method comprising only temperature holding, energy-saving is easier.

Steels suitable for this embodiment are high carbon steels consisting of 0.6 to 0.9% C, 0.25 to 2.0% Si, 0.5 to 2.0% Mn, 0.3 to 1.0% Cr and the balance Fe and unavoidable impurities.

The temperature to be held for ageing recovery is preferably 100° to 500° C., since if lower than 100° C., the ageing effect or recovery is not complete and not favourably compared with the natural ageing, while if higher than 500° C., the strength is lowered due to annealing effect. The holding time is preferably 3 to 50 hours, since if less than 3 hours, a complete ageing recovery cannot be obtained, while if more than 50 hours, the ageing recovery is saturated and a further improvement to toughness is no longer expected.

This embodiment can readily be carried out by providing a holding furnace near the cooling apparatus in a rolling mill, charging a steel bar cooled at room temperature therein and holding at a suitable temperature, or providing the cooling apparatus with a means for measuring the temperature of a steel bar and charging the steel bar in the holding furnace when cooled to the holding temperature. The heating temperature in the holding furnace is relatively low, i.e. at most 500° C. and accordingly, for instance, the waste gas from the heating furnace for rolling can readily be used as a heat source of the holding furnace.

In a still further embodiment of the present invention, a high carbon steel bar excellent in yield stress and straightness is produced by a process comprising cooling a hot rolled steel bar at a constant rate, characterized by carrying out the cooling in such a manner that the perlite transformation is started at a temperature of ranging from Tc to (Tc+40° C.) wherein Tc is the critical temperature at which a cooling curve at a constant rate is tangent to the perlite transformation starting line of CCT curve of the steel bar and the maximum temperature during the transformation is suppressed to at most (Tc+80° C.), subjecting the steel bar to a forced ageing after cooling to room temperature or on the way to cooling to room temperature and imparting a tensile stress below the breaking stress and above the yield stress to the steel bar during the forced ageing or after the forced ageing and while cooling to room temperature.

According to this embodiment, it is found that under the above described condition, a stress is given to a steel bar subjected to the perlite transformation immediately after hot rolling, thereby giving a further excellent straightness and high yield stress thereto.

Steels suitable for this embodiment are high carbon steels consisting of 0.5 to 0.9% C, 0.25 to 2.0% Si, 0.5 to 2.0 Mc, 0.3 to 1.0% Cr and the balance Fe and unavoidable impurities.

The forced ageing can readily be carried out by providing a holding furnace near the cooling apparatus in a rolling mill, charging a steel bar cooled at room temperature therein and holding at a suitable temperature, or providing the cooling apparatus with a means for measuring the temperature of a steel bar and charging the steel bar in the holding furnace when cooled to the holding temperature.

This embodiment is carried out by holding both the ends of the steel bar by means of a chuck while it is charged and held in the holding furnace or while it is discharged from the holding furnace and cooled to room temperature, and imparting to the steel bar a tensile strength below the breaking strength and above the yield stress. The stress imparted herein should be of course less than the breaking strength and preferably more than the yield stress in order to raise the yield stress although a stress of less than the yield stress results in improvement of relaxation.

When this embodiment is carried out on the way to the forced ageing, furthermore, diffusion of hydrogen in the steel is accelerated to thus shorten the forced ageing time.

According to the present invention, there can be provided in stable manner a large-size diameter hot rolled steel bar with a higher strength and higher toughness by controlling the perlite transformation temperature without adding expensive elements for increasing hardenability.

The following examples are given in order to illustrate the present invention in detail without limiting the same.

EXAMPLE 1

When a hot rolled steel bar of 32 mm in diameter containing components shown in Table 1 was cooled continuously from 950° C. at various cooling rates by the use of nozzles for water or mist, perlite transformation did not take place but martensite transformation took place at a cooling rate of faster than 2.3° C./sec and perlite transformation took place from 570° C. first at a cooling rate of 2.3° C./sec.

TABLE 1

| Components | C | Si | Mn | P | S | Cr |
|---|---|---|---|---|---|---|
| % by weight | 0.75 | 0.81 | 1.21 | 0.010 | 0.004 | 0.80 |

Figure 2:
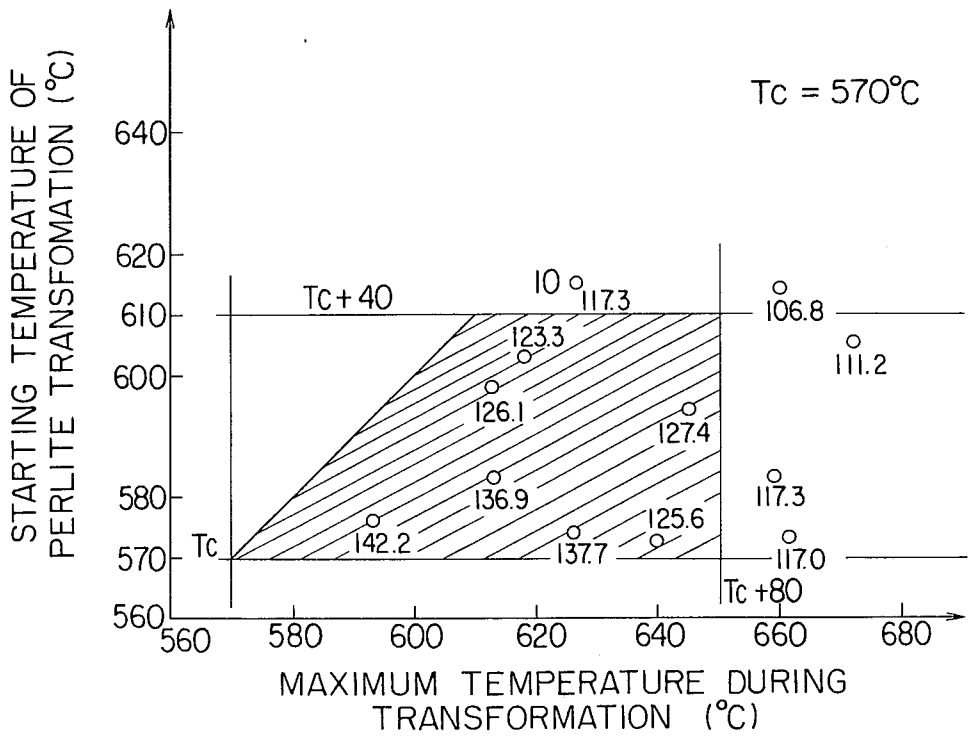
FIG. 2 shows a perlite transformation temperature control range (shaded range), in which steel bars of the present invention are obtained at Tc=570° C. in Example 1 of the present invention, and the tensile strength (kg/mm$^2$) of the obtained steel bars.

Thus, the above described steel bar of Tc=570° C. was subjected to a test of tensile strength (kg/mm$^2$) by varying the perlite transformation starting temperature and the maximum temperature in the perlite transformation as shown in Table 2, thus obtaining results shown in Table 2 and FIG. 2 in which the ordinate is starting temperature of perlite transformation (°C) and the abscissa is maximum temperature (°C) during perlite transformation, the numerals representing tensile strength (kg/mm$^2$) and the shaded portion representing the temperature range of the present invention.

TABLE 2

| No. | Perlite Transformation Starting Temperature (°C.) | Maximum Temperature in Perlite Transformation (°C.) | Tensile Strength (kg/mm$^2$) | Remarks |
|---|---|---|---|---|
| 1 | 573 | 640 | 125.6 | Our Invention |
| 2 | 573 | 661 | 117.0 | — |
| 3 | 574 | 626 | 137.7 | Our Invention |
| 4 | 576 | 583 | 142.2 | Our Invention |
| 5 | 583 | 613 | 136.9 | Our Invention |
| 6 | 583 | 659 | 117.3 | — |
| 7 | 594 | 645 | 127.4 | Our Invention |
| 8 | 598 | 613 | 126.1 | Our Invention |
| 9 | 603 | 628 | 123.3 | Our Invention |
| 10 | 605 | 672 | 111.2 | — |
| 11 | 614 | 660 | 109.8 | — |
| 12 | 615 | 627 | 117.3 | — |

When a hot rolled steel bar was cooled at a constant rate, the perlite transformation was started at a temperature range of Tc to (Tc+40° C.) wherein Tc is the critical temperature at which a cooling curve at a constant rate is tangent to the perlite transformation starting line of CCT curve of the steel bar and the maximum temperature in the perlite transformation was suppressed to at most (Tc+80° C.), thereby obtaining a steel bar of 20 mm in diameter and a tensile strength of at least 120 kg/mm$^2$.

EXAMPLE 2

As to a steel bar of 32 mm in diameter containing components shown in Table 1, the finishing rolling temperature was varied within a range of 750° to 1050° C. and forced cooling was carried out using water or mist to give a perlite transformation starting temperature of 590° C. and a maximum temperature during perlite transformation of 640° C.

The relationship between the finishing rolling temperature and mechanical properties is shown in Table 3 as average vales of 8 times:

TABLE 3

| No. | Finishing Rolling Temperature (°C.) | Austenite Crystal Grain Size (ASTM No.) | Tensile Strength (kg/mm$^2$) | Reduction of Area (%) | Remarks |
|---|---|---|---|---|---|
| 1 | 1050 | 3.7 | 128.4 | 15.4 | — |
| 2 | 1000 | 6.2 | 127.9 | 18.2 | — |
| 3 | 950 | 8.4 | 128.3 | 22.3 | Our Invention |
| 4 | 900 | 9.3 | 127.1 | 27.4 | Our Invention |
| 5 | 850 | 11.2 | 127.9 | 33.6 | Our Invention |
| 6 | 800 | 13.4 | 126.4 | 40.6 | Our Invention |
| 7 | 750 | 14.8 | 126.8 | 45.3 | Our Invention |

Even as to a hot rolled steel bar with an austenite crystal grain or smaller than ASTM No. 8, a reduction of area of 20% or more and a tensile strength of 120 kg/mm$^2$ or more could be obtained with a diameter of 20 mm or more.

EXAMPLE 3

Figure 6:
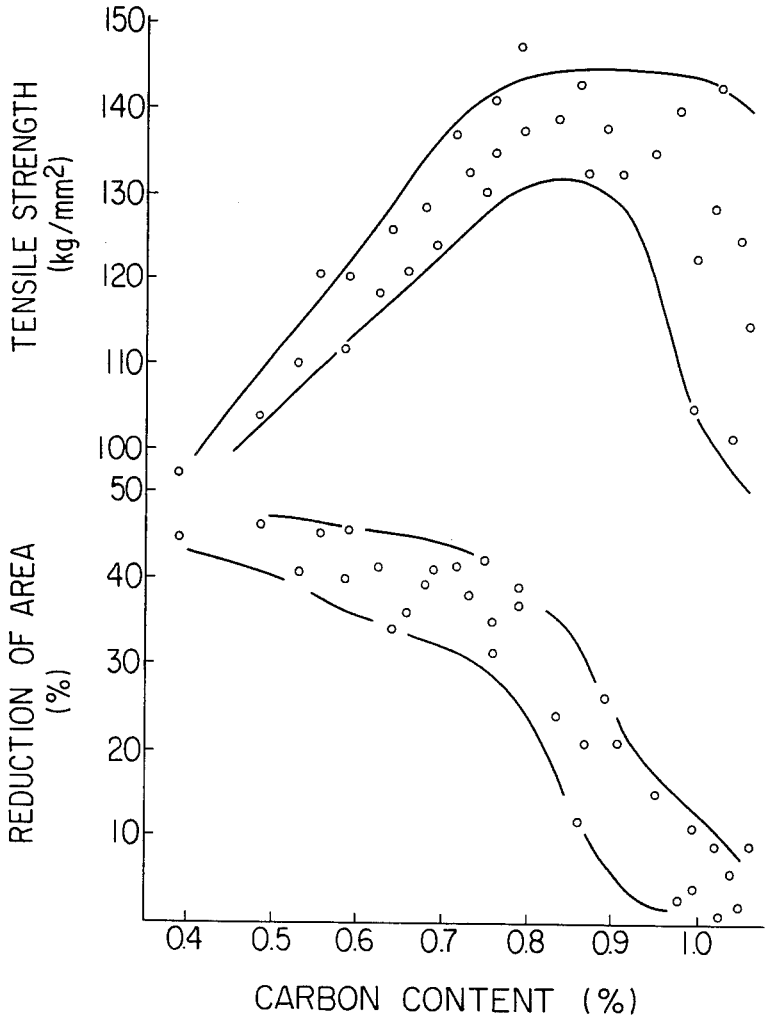
FIG. 6 is a graph showing the relationship of the tensile strength vs carbon content and the reduction of area vs carbon content.

Steels having chemical compositions of 0.39 to 1.06 % C, 0.65 to 0.90% Si, 1.10 to 1.30% Mn, 0.65 to 0.95 % Cr and the balance Fe and unavoidable impurities were hot rolled at a finishing rolling temperature of 950° C. in a diameter of 32 mm, subjected to the controlled cooling according to the present invention and then to a test of tensile strength and reduction of area, thus obtaining results as shown in FIG. 6 in which the ordinate shows tensile strength (kg/mm$^2$) and reduction of area (%) and the abscissa shows carbon content (%).

The tensile strength increases with the increase of the carbon content, but when the carbon content exceeds 0.9% , the reduction of area is lowered and the tensile strength is also lowered with increased dispersion.

EXAMPLE 4

Figure 8:
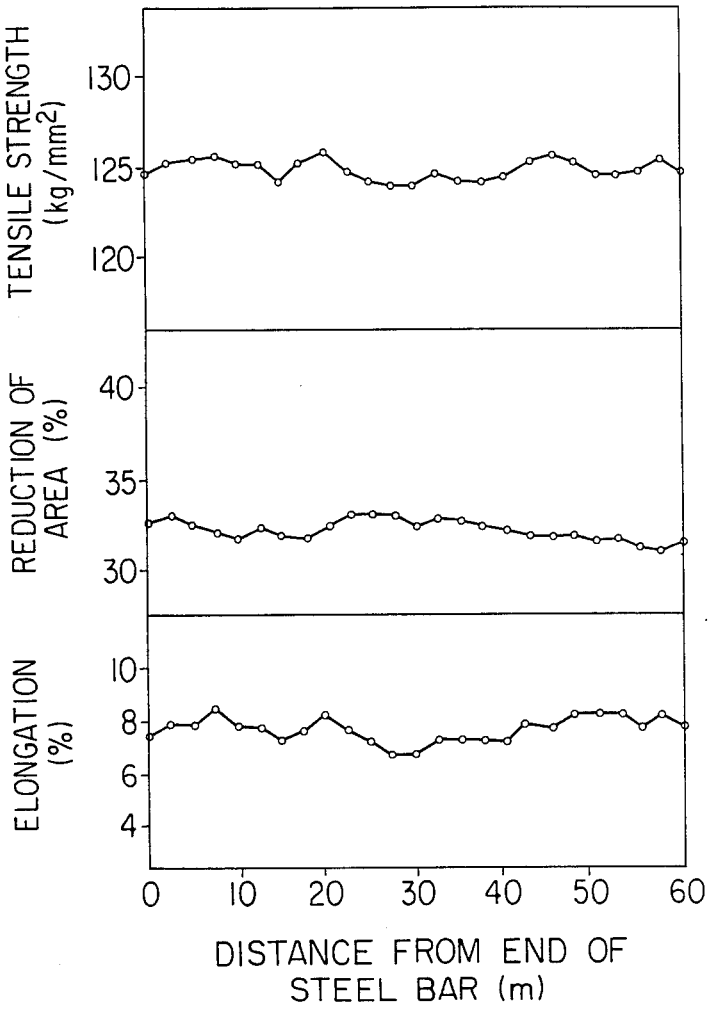
FIG. 8 to FIG. 10 are graphs showing the tensile strength, reduction of area and elongation over the whole length (60 m) of a steel bar, obtained in Examples of the present invention.

The steel bar (Tc=570° C.) of Example 1 was hot rolled and subjected to the controlled cooling, determining the perlite transformation starting temperature and maximum temperature during perlite transformation respectively to 600° C. and 630° C., by revolving the steel bar at 60 rpm and forwarding at a rate of 80 mm/sec, while applying uniform blast at 40 m/sec at a temperature range of 950 to 500° C. The mechanical properties of the steel bar thus obtained are shown in FIG. 8.

As is evident from the results, the steel bar having uniform and excellent mechanical properties over the whole length (60 m) is obtained by the controlled cooling according to the present invention.

EXAMPLE 5

Figure 9:
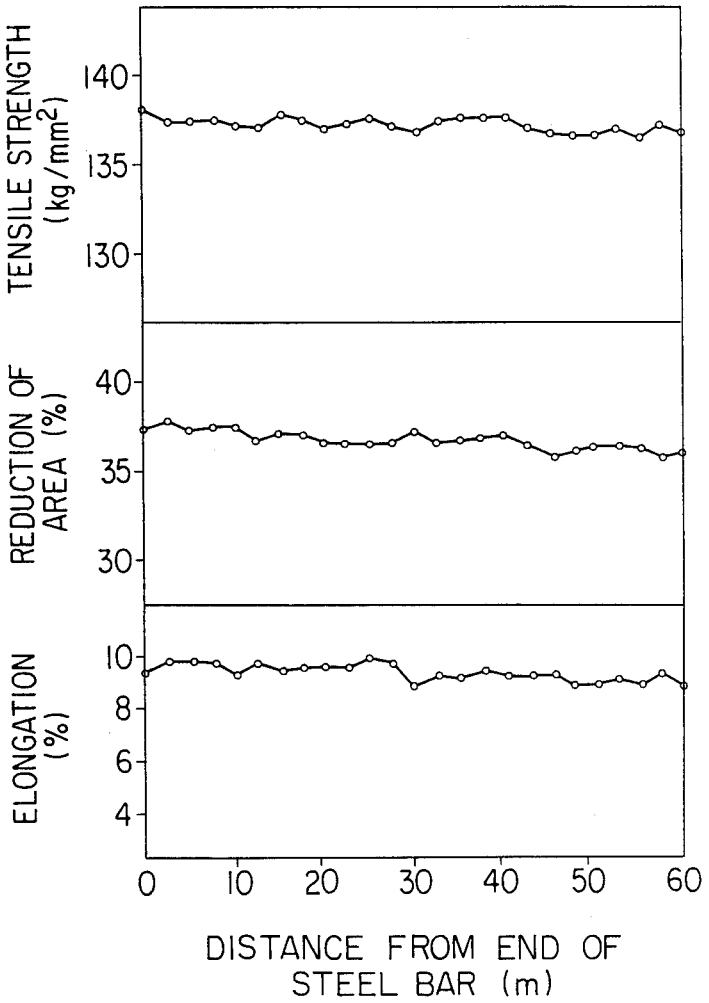

The steel bar (Tc=570° C.), hot rolled, was subjected to the controlled cooling, determining the perlite transformation starting temperature and the maximum temperature in the perlite transformation respectively to 580° C. and 610° C., by revolving rolls for rotation at a rate of 60 rpm and rolls for forwarding at a rate of 50 rpm to reciprocate the steel bar at a spacing of about 400 mm, thus imparting rotating and forwarding motions to the steel bar, while applying uniformly a mist of steam (1.2 atm) and air (1.5 atm) at a temperature range of 950° to 500° C. The mechanical properties of the thus resulting steel bar are shown in FIG. 9.

As is evident from the results, the steel bar having uniform and excellent mechanical properties over the whole length (60 m) is obtained by the controlled cooling according to the present invention.

EXAMPLE 6

Figure 10:
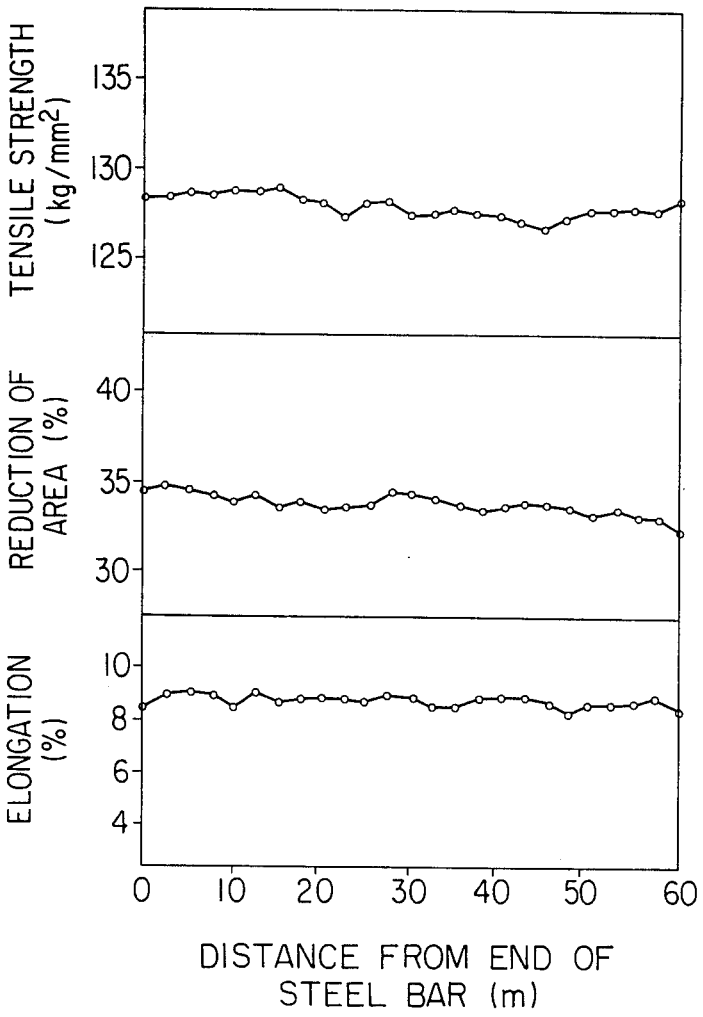

The steel bar (Tc=570° C.) of Example 1, hot rolled, was subjected to the controlled cooling, determining the perlite transformation starting temperature and the maximum temperature during the perlite transformation respectively to 595° C. and 610° C., by feeding the steel bar to a rotating and forwarding system comprising drum-shaped rolls arranged in parallel and slantly by 45 degrees to the axial direction, revolving the rolls at a rate of 50 rpm and reversing at intervals of 5 seconds to reciprocate the steel bar at a spacing of about 400 mm, while applying uniformly blast at 40 m/sec to cool from 950° C. to the perlite transformation starting temperature, and thereafter removing the steel bar to another line of the rolls arranged in parallel, while applying uniformly a mist of water (1.2 atm) and air (1.5 atm) to cool from the perlite transformation starting temperature to the maximum temperature during the perlite transformation. The mechanical properties of the thus resulting steel bar are shown in FIG. 10.

As is evident from the results, the steel bar having uniform and excellent mechanical properties over the whole length (60 m) is obtained by the controlled cooling according to the present invention.

EXAMPLE 7

A billet of 115 mm in diameter, containing 0.75% C, 0.81% Si, 1.21% Mn and 0.80% Cr, was heated at 1200° C., hot rolled at a finishing rolling temperature of 940° C. in a diameter of 32 mm and control cooled by forwarding the hot rolled steel bar at a rate of 6 m/min and revolving at 60 rpm, while applying a mixed jet (mist) of air and water as a cooling medium thereto. By this controlled cooling, the perlite transformation starting temperature was 590°±5° C. and the maximum temperature during the perlite transformation was 640°±6° C.

The resulting steel bar was subjected to a tension test, thus obtaining a mean tensile strength of 128.4 kg/mm$^2$ with a dispersion of 1.93 kg/mm$^2$.

EXAMPLE 8

The high carbon steel billet of Example 7 was hot rolled by 12 passes to give a steel bar of 32 mm in diameter, during which by providing a holding furnace having a temperature distribution of 950±°10° C., the material to be rolled was held for 30 minutes before 2 passes from the finishing rolling, followed by adding 36% of the rolling work in 2 passes and cooling.

Figure 13:
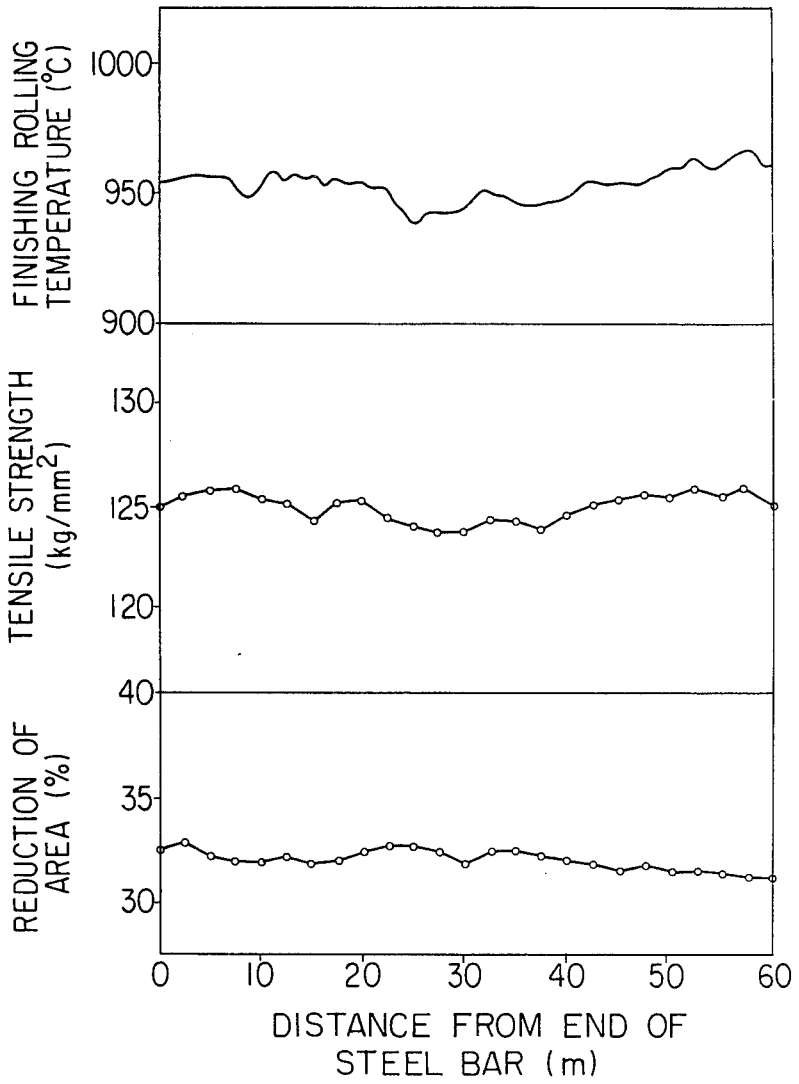
FIG. 13 is a graph showing the relationship of the finishing rolling temperature, tensile strength and reduction of area vs the position from the end of a steel bar obtained according to the process of the present invention.

The rolling temperature and the mechanical properties of the steel bar are shown in FIG. 13. When the material to be rolled is held in a holding furnace, the temperature width of the finishing rolling temperature can be made uniform and small, i.e. within 25° C. and there can be obtained a steel bar having uniform mechanical properties (tensile strength and reduction of area) over the whole length (60 m), as shown in FIG. 13.

When another experiment was carried out by holding in a holding furnace for 15 minutes, substantially similar results were obtained as to the mechanical properties and distribution thereof.

EXAMPLE 9

The high carbon steel billet of Example 7 was hot rolled by 12 passes to give a steel bar of 32 mm in diameter. During the same time, a radiation thermometer and forced cooling apparatus (spray nozzle) were provided, the material to be rolled was held at 950°±10° C. before 2 passes from the finishing rolling and then subjected to 36% of the rolling work in 2 passes, followed by controlled cooling.

When the hot rolled steel bar was continuously cooled from 950° C. at various cooling rates, perlite transformation did not take place but martensite transformation took place at a cooling rate of faster than 2.3° C./sec and perlite transformation took place from 570° C. first at a cooling rate of 2.3° C./sec.

Determining the critical temperature of the steel bar to Tc=570° C., the steel bar was subjected to controlled cooling by means of mist nozzles so that the perlite transformation starting temperature be 590° C. and the maximum temperature during the perlite transformation be 640° C.

The temperature width of the finishing rolling temperature can be made uniform and very small, i.e. within 20° C. by forced cooling of the material to be rolled, and moreover, the thus hot rolled steel bar was subjected to the controlled cooling, thus obtaining a steel bar with uniform and excellent mechanical properties (strength and toughness) over the whole length (60 m).

EXAMPLE 10

A high carbon steel bar of 32 mm in diameter, containing 0.75% C, 0.81% Si, 1.12% Mn and 0.80% Cr, hot rolled, was subjected to the perlite transformation and cooled to room temperature. The reduction of area, immediately after rolling and cooling, was about 6–7 %.

Figure 14:
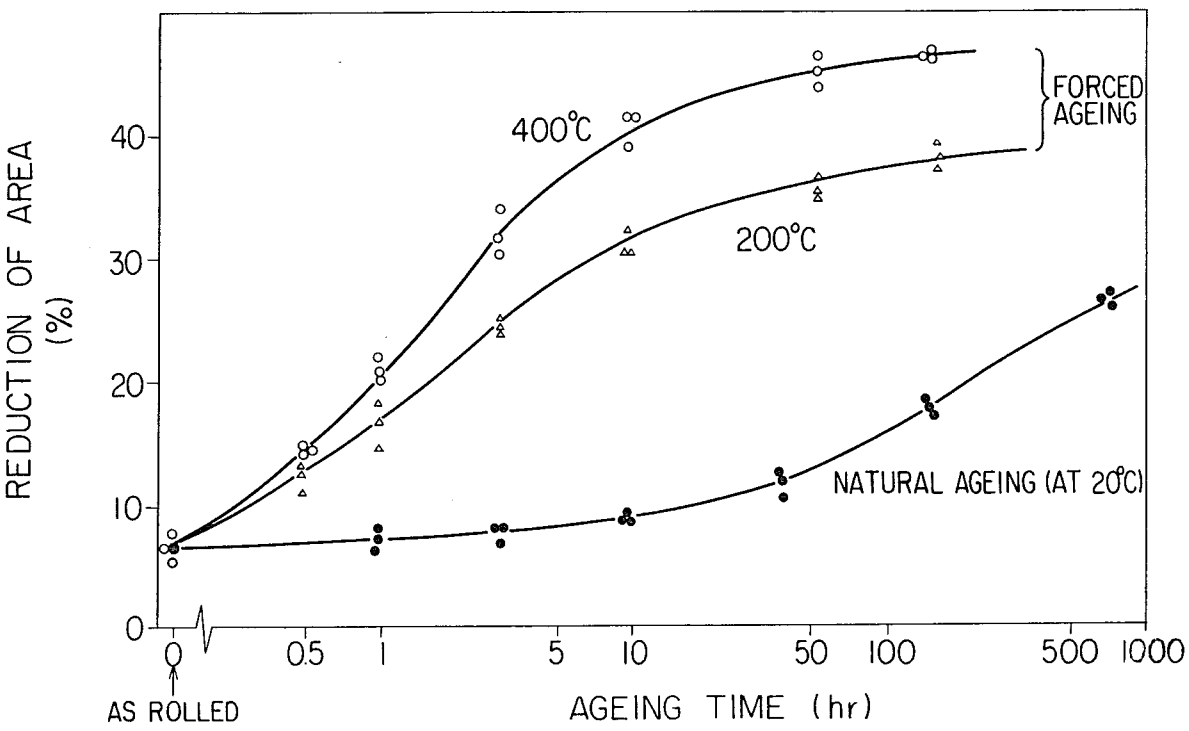
FIG. 14 is a graph showing the change of toughness (reduction of area) with time when a steel bar is subjected to natural ageing and forced ageing.

When this steel bar was allowed to stand naturally or held at 200° C. and 400° C. in a holding furnace, changes of the toughness (reduction of area) with the passage of time were measured to obtain results as shown in FIG. 14.

As apparent from FIG. 14, in the case of allowing to stand at room temperature (20° C.), the natural ageing proceeds very slowly and even after about one month (700 hours), a sufficient ageing recovery does not occur, the toughness being kept low. In the case of subjecting the steel bar to the forced ageing at 200° C. and 400° C., on the contrary, the reduction of area is recovered to 28 to 40% in about 10 hours and 35 to 45% in about 50 hours.

EXAMPLE 11

A hot rolled steel bar of 32 mm in diameter, containing components shown in Table 4, was subjected to forced ageing at various temperatures after rolling and cooling to measure changes of the toughness (reduction of area) with the passage of time.

TABLE 4

| Component | C | Si | Mn | P | S | Cr |
|---|---|---|---|---|---|---|
| % by weight | 0.76 | 0.82 | 1.18 | 0.010 | 0.004 | 0.82 |

Figure 15:
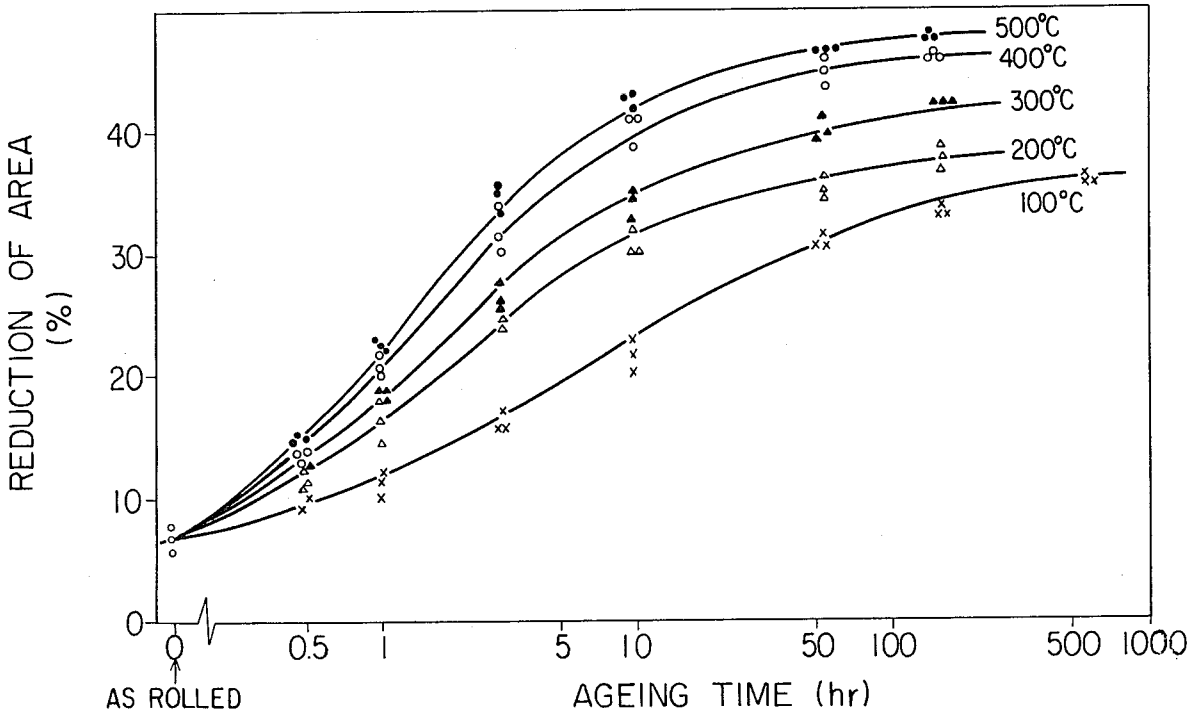
FIG. 15 is a graph showing the change of toughness (reduction of area) with time when a steel bar, cooled to room temperature, is heated and held at various temperatures.

The results are as shown in FIG. 15, in which the ordinate represents reduction of area (%) and the abscissa respresents holding time, i.e. ageing time. As is evident from FIG. 15, the reduction of area is about 2 times in about 3 hours even at 100° C. and there is obtained a hot rolled steel bar having an excellent toughness by the forced ageing at 100° to 500° C. for 3 to 50 hours.

EXAMPLE 12

Figure 16:
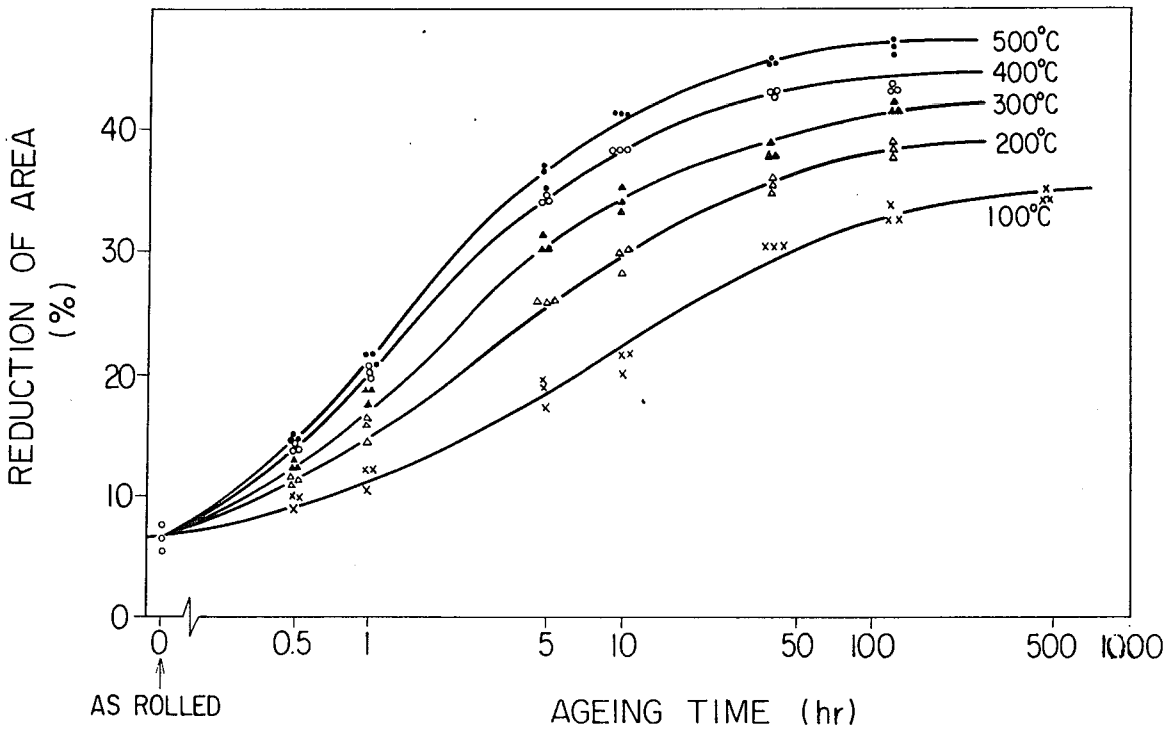
FIG. 16 is a graph showing the change of toughness (reduction of area) with the passage of time when a steel bar is held at various temperatures during cooling.

The steel bar of Example 11 was subjected to forced ageing at various temperatures by holding at the temperature while rolling and cooling to measure changes of the toughness (reduction of area) with the passage of time, thus obtaining results as shown in FIG. 16.

EXAMPLE 13

The high carbon steel bar of Example 10, hot rolled, was subjected to the perlite transformation by the controlled cooling using a mist and cooled to room temperature. The resulting steel bar had a yield stress corresponding to 85% of the breaking strength immediately after rolling and cooling. As to the straightness, a curvature of about 4.8 mm was observed per 1 m of the steel bar.

This steel bar was charged in a holding furnace at 300° C. after rolling and cooling and held for 40 hours, and immediately, a tensile strength corresponding to 95 % of the breaking strength was imparted thereto. Then, the mechanical properties and straightness were measured, thus obtaining results as shown in FIG. 17 with those of the prior art imparting no tensile stress.

Figure 17:
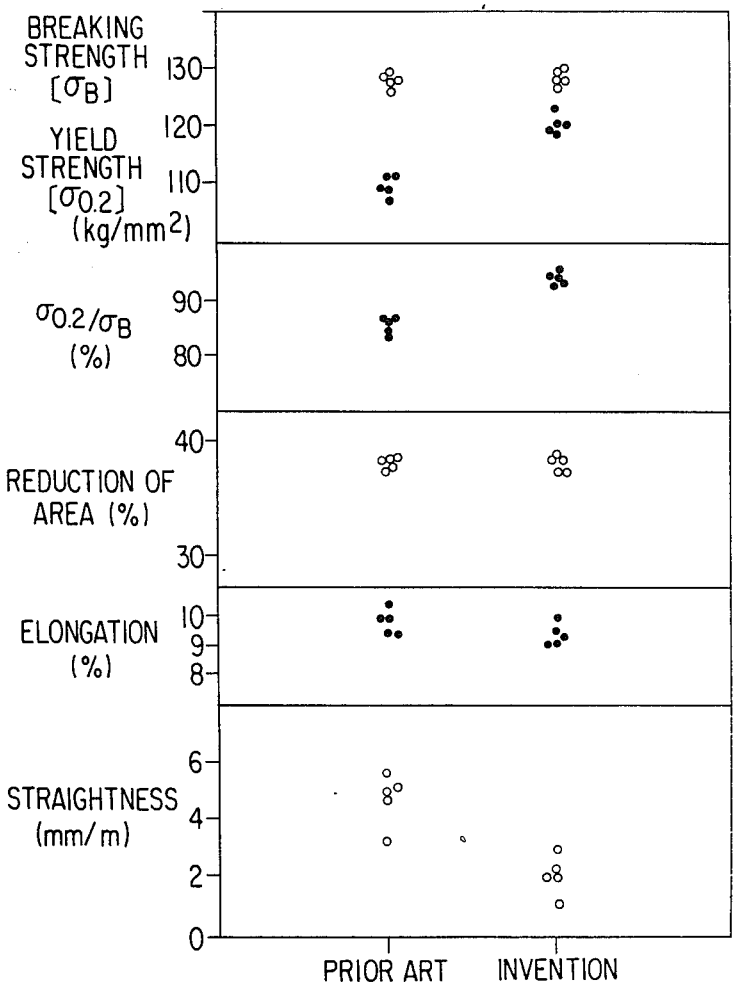
FIG. 17 is a graph showing the mechanical properties and straightness when a steel bar, cooled at room temperature, is held at 300° C. for 40 hours and then subjected to a tensile strength corresponding to 95% of the breaking strength on the way of cooling to room temperature, or not subjected to such a tensile strength.

As is apparent from FIG. 17, there is not such a large difference in breaking strength between the steel bar of the present invention and that of the prior art, but the yield stress is markedly improved and the curvature is corrected to give an excellent straightness in the case of the present invention.

EXAMPLE 14

Figure 18:
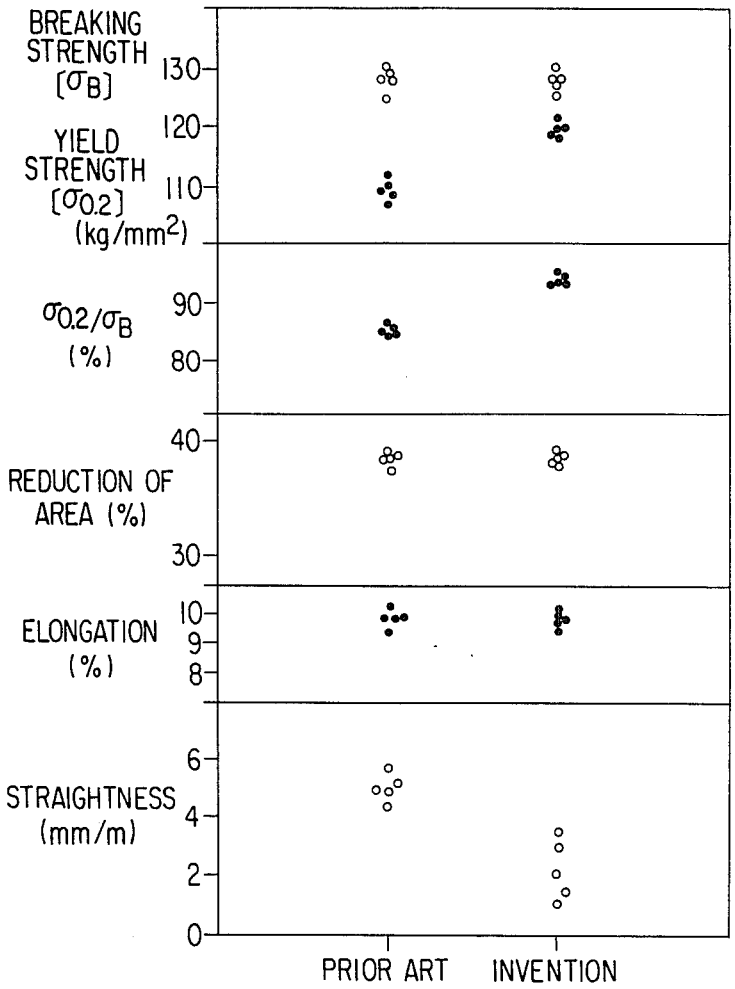
FIG. 18 is a graph showing the mechanical properties and straightness when a steel bar is held at a temperature of 400° C. on the way of cooling after rolling and subjected to a tensile strength corresponding to 95% of the breaking strength, or not subjected to such a tensile strength.

The high carbon steel bar of Example 10 reaching 400° C. during hot rolling and cooling was charged in a holding furnace at the same temperature and held for about 2 hours. A tensile strength corresponding to 95 % of the breaking strength was imparted to the steel bar in an analogous manner to Example 14, and the steel bar was then subjected to forced ageing for 13 hours and cooled to room temperature. Then, the mechanical properties and straightness of the steel bar were measured to obtain results as shown in FIG. 18 with those of the prior art applying no tensile stress.

EXAMPLE 15

Steels having the following chemical compositions were hot rolled to form a steel bar of 32 mm in diameter with a finishing rolling temperature of 950° C., subjected to the controlled cooling and forced ageing according to the present invention and a stress corresponding to 95 % of the breaking strength was imparted to the steel bar, which was then subjected to a tension test, thus obtaining results shown in Table 6.

TABLE 5

| | Chemical Components (%) | | | | | |
|---|---|---|---|---|---|---|
| Steel | C | Si | Mn | Cr | Ni | Mo |
| A | 0.74 | 0.80 | 1.20 | 0.40 | — | — |
| B | 0.76 | 0.79 | 1.22 | 0.81 | — | — |
| C | 0.75 | 0.79 | 0.20 | 0.80 | 0.30 | — |
| D | 0.74 | 0.80 | 0.21 | 0.79 | 0.25 | 0.11 |
| E | 0.76 | 0.81 | 0.23 | 0.81 | 0.50 | 0.20 |

TABLE 6

| Steel | Tensile Strength ($kg/mm^2$) | Yield Point ($kg/mm^2$) | Reduction of Area (%) |
|---|---|---|---|
| A | 121.9 | 114.5 | 33.1 |
| B | 127.6 | 120.0 | 35.4 |
| C | 126.5 | 118.1 | 33.8 |
| D | 129.3 | 121.8 | 36.2 |
| E | 131.7 | 124.1 | 31.7 |

What is claimed is:

1. A large diameter high strength hot rolled straight steel bar consisting of a low alloy steel having a carbon content of 0.3 to 0.9% and uniformly throughout the cross-section thereof, a metallurgical structure with a inter-lammelar spacing of 0.05 to 0.15 μm, and having a diameter of at least 20 mm, a tensile strength of at least 120 $kg/mm^2$ and a reduction of area of at least 20%.

2. The large diameter high strength hot rolled straight steel bar of claim 1, wherein the low alloy steel consists of 0.6 to 0.9% C, 0.25 to 2.0% Si, 0.5 to 2.0% Mn, 0.3 to 1.0% Cr and the balance Fe and unavoidable impurities.

3. The large diameter high strength hot rolled straight steel bar of claim 1, wherein the low alloy steel is obtained by a process comprising cooling a hot rolled steel at a constant rate, wherein the cooling is carried out in such a controlled manner that the perlite transformation is started at a temperature of ranging from Tc to (Tc+40° C.) wherein Tc is the critical temperature at which a cooling curve at a constant rate is tangent to the perlite transformation starting line of the continuous cooling transformation curve and the maximum temperature during the transformation is suppressed to at most (Tc+80° C.).

4. A process for the production of a high strength straight steel bar having a diameter of at least 20 mm, which has been subjected to a hot rolling, comprising cooling a hot rolled steel bar at a constant rate, wherein the cooling is carried out in such a controlled manner that the perlite transformation is started at a temperature of ranging from Tc to (Tc+40° C.) wherein Tc is the critical temperature at which a cooling curve at a constant rate is tangent to the perlite transformation starting line of the continuous cooling transformation curve and the maximum temperature during the transformation is suppressed to at most (Tc+80° C.).

5. The process of claim 4, wherein the cooling is carried by spraying water or mist onto the steel bar.

6. The process of claim 4, wherein the hot rolled straight steel bar has a crystal grain size of smaller than according to ASTM No. 8 obtained by controlling the finishing rolling temperature.

7. The process of claim 4, wherein the hot rolled straight steel bar consists of a low alloy steel consisting of 0.6 to 0.9% C, 0.25 to 2.0% Si, 0.5 to 2.0% Mn, 0.3 to 1.0% Cr and the balance Fe and unavoidable impurities.

8. The process of claim 4, wherein the cooling is carried out by blasting at a steel bar temperature of 950° to 500° C.

9. The process of claim 4, wherein the cooling is carried out by spraying a mist at a steel bar temperature of 950° to 500° C.

10. The process of claim 4, wherein the cooling is carried out by blasting before the perlite transformation is started and by spraying a mist after the perlite transformation is started.

11. The process of claim 4, wherein the cooling is carried out while revolving or moving the steel bar in the axial direction.

12. The process of claim 11, wherein the revolving or axial moving of the steel bar is carried out by means of rolls.

13. The process of claim 12, wherein the rolls are drum-shaped or centrally tapered rolls.

14. The process of claim 4, wherein the cooling is carried out by fitting a plurality of temperature sensers to the steel bar throughout the temperature range immediately after rolling and before completion of the cooling and thereby recording a cooling pattern.

15. The process of claim 4, wherein the hot rolled steel bar is held, during hot rolling, at a temperature of 800° to 1000° C. in a holding furnace to keep the fluctuation width of the temperature distribution over the whole length within at most 60° C.

16. The process of claim 4, wherein the hot rolled straight steel bar is cooled to room temperature and then subjected to forced ageing by heating and holding at a temperature of 100° to 500° C. for 3 to 50 hours.

17. The process of claim 4, wherein when the hot rolled straight steel bar reaches a temperature of 100° to 500° C. on the way to cooling, the steel bar is subjected to forced ageing by holding at the same temperature for 3 to 50 hours.

18. The process of claim 17, wherein a tensile strength of less than the breaking strength and more than the yield stress is imparted to the steel bar during or after the forced ageing

* * * * *